US005685785A

United States Patent [19]

Kakiuchi et al.

[11] Patent Number: 5,685,785

[45] Date of Patent: Nov. 11, 1997

[54] WOUND GOLF BALL

[75] Inventors: Shinichi Kakiuchi; Junji Umezawa, both of Chichibu, Japan

[73] Assignee: Bridgestone Sports Co., Ltd., Tokyo, Japan

[21] Appl. No.: 623,778

[22] Filed: Mar. 29, 1996

[30] Foreign Application Priority Data

Apr. 4, 1995 [JP] Japan ..... 7-103123

[51] Int. Cl.[6] ..... A63B 37/08; A63B 37/12; A63B 37/06

[52] U.S. Cl. ..... 473/354; 473/365; 473/362

[58] Field of Search ..... 473/362, 354, 473/361, 365, 378

[56] References Cited

U.S. PATENT DOCUMENTS

| | | | |
|---|---|---|---|
| 809,034 | 1/1906 | Thomas | 473/362 |
| 1,857,518 | 5/1932 | Sibley | 473/362 |
| 2,200,257 | 5/1940 | Bogoslowsky | 473/362 |
| 4,783,078 | 11/1988 | Brown et al. | 473/362 |

FOREIGN PATENT DOCUMENTS 2 202 154 9/1988 United Kingdom .

*Primary Examiner*—George J. Marlo
*Attorney, Agent, or Firm*—Sughrue,Mion,Zinn,Macpeak & Seas, PLLC

[57] ABSTRACT

In a wound golf ball comprising a wound core (3) having thread rubber wound on a center (1) to form a thread rubber layer (2) thereon and a cover (4) around the wound core, the thread rubber layer (2) consists of an inner lamina (2*a*) of lightly wound thread rubber, an intermediate lamina (2*b*) of tightly wound read rubber, and an outer lamina (2*c*) of lightly wound thread rubber. The inner lamina occupies 10–35% of the tread rubber volume, the intermediate lamina 35–70% of the tread rubber volume and the outer lamina is 45% of the tread rubber volume. The inner and outer lamina have an elongation which is at least 40% lower than the elongation of the intermediate lamina.

13 Claims, 2 Drawing Sheets

WOUND GOLF BALL

BACKGROUND OF THE INVENTION

1. Field of the Invention

This invention relates to a thread wound golf ball which is improved in flying distance and durability.

2. Prior Art

The thread rubber laser of the wound golf ball is a key component for improving the restitution of the ball upon impact. A number of improvements in the thread rubber layer were proposed in the art for further increasing the restitution.

One exemplary wound golf ball is disclosed in Japanese Patent Application Kokai (JP-A) No. 137374/1985. As shown in FIG. 2, this golf ball includes a wound core 3 and a cover 4 thereon. The wound core 3 is formed by winding thread rubber on a center 1 as a thread rubber layer 2. The thread rubber layer 2 includes two concentric laminas, an inner lamina 2A of tightly wound thread rubber and an outer lamina 2B of lightly wound thread rubber, which contribute to the improved restitution of the ball. Although JP-A 137374/1985 succeeded in improving restitution by tailoring the thread rubber layer into a two layer structure, the ball was less durable. Upon repetitive shots, the golf ball lost its performance because the thread rubber layer could be deformed.

For improving durability, Japanese Patent Publication (JP-B) No. 45270/1993 discloses a wound golf ball having a thread rubber layer of a two layer structure as shown in FIG. 2. The thread rubber layer 2 includes an inner lamina 2A nearer to the center and an outer lamina 2B. The inner lamina 2A occupies 3 to 75% by volume of the entire thread rubber layer and the thread rubber of the lamina 2A is wound under a tension which is at least 20% lower than the tension under which the thread rubber of the lamina 2B is wound. This golf ball has insufficient restitution.

SUMMARY OF THE INVENTION.

An object of the present invention is to provide a thread wound golf ball which is improved in restitution and remains durable.

We have found that a wound golf ball is improved in restitution, flying distance and durability by tailoring the thread rubber layer into a multilayer structure consisting essentially of an inner lamina of lightly wound thread rubber, an intermediate lamina of tightly wound read rubber, and an outer lamina of lightly wound thread rubber. When shot by a driver, the ball exhibits good restitution and an increased initial velocity, and hence, travels an increased flying distance. Additionally the ball is fully durable.

Therefore, the present invention provides a wound golf ball comprising a wound core having thread rubber wound on a center to form a thread rubber layer thereon and a cover around the wound core. The thread rubber layer consists essentially of three laminas, an inner lamina of lightly wound thread rubber, an intermediate lamina of tightly wound read rubber, and an outer lamina of lightly wound thread rubber.

BRIEF DESCRIPTION OF THE DRAWINGS

These and further features of the present invention will be apparent with reference to the following description and drawings, wherein.

DETAILED DESCRIPTION OF THE INVENTION

Figure 1:
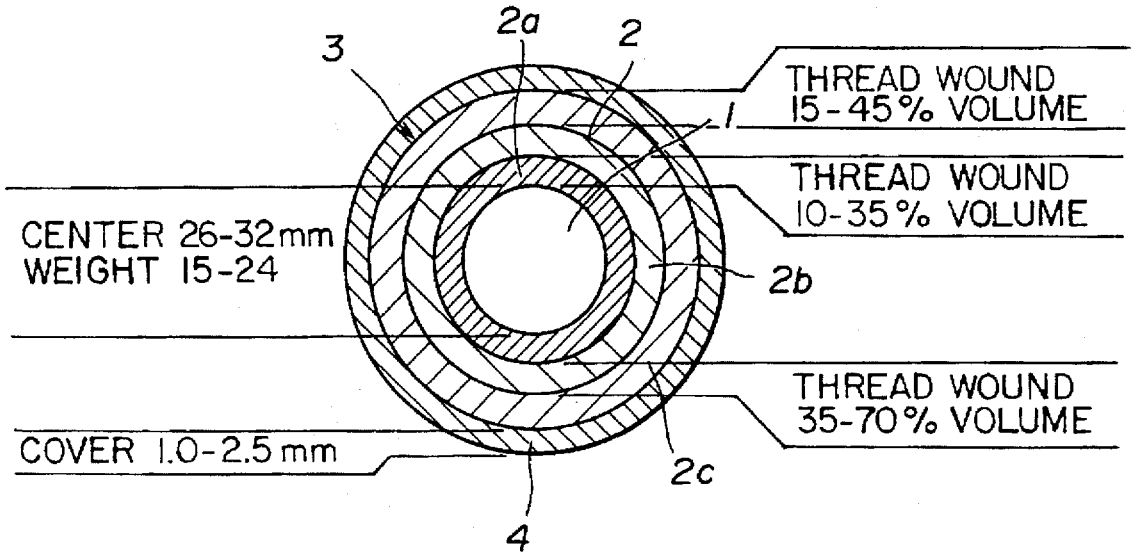
FIG. 1 is a schematic cross-sectional view of a wound golf ball according to the invention.
Figure 2:
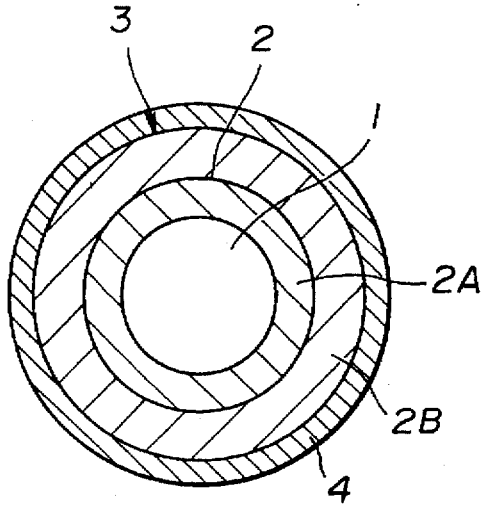
FIG.2 PRIOR ART
FIG. 2 is a schematic cross-sectional view of a prior art wound golf ball.

Referring to FIG. 1, there is illustrated a thread wound golf ball of the invention as comprising a wound core 3 having thread rubber wound on a spherical center 1 to form a thread rubber layer 2 thereon. A concentric cover 4 encloses the wound core 3.

In the practice of the invention, the center 1 may be either a liquid center or a solid center. These centers may be prepared from well-known materials in a well-known manner. The liquid center consists of a hollow spherical center bag and a fill liquid such as water. The center bag may be made of a conventional composition. The solid center may be made of a conventional composition. The center preferably has an outer diameter of 26 to 32 mm and a weight of 15 to 24 grams.

The thread rubber layer 2 is formed by winding thread rubber on the center 1. According to the invention, the thread rubber layer 2 has a three-layer structure, that is, consists essentially of three concentric laminas, an inner lamina 2*a* of lightly wound thread rubber, an intermediate lamina 2*b* of tightly wound read rubber, and an outer lamina 2*c* of lightly wound thread rubber.

Preferably the inner lamina 2*a*, the intermediate lamina 2*b*, and the outer lamina 2*c* occupy 10 to 35%, 35 to 70%, and 15 to 45% by volume of the entire volume of the thread rubber layer, respectively.

Also preferably, the respective thread rubber laminas have selected elongation rates. The elongation of inner lamina 2*a* is at least 40%, especially 50 to 80% lower than the elongation of the intermediate lamina 2*b*. The elongation of outer lamina 2*c* is at least 40%, especially 50 to 80% lower than the elongation of the intermediate lamina 2*b*. Then the object of the invention is more effectively achieved. The "elongation" is as defined in Example.

The thread rubber may be polyisoprene rubber or a mixture of polyisoprene rubber and natural rubber, for example. It may be wound by any of well-known conventional techniques. Typically the thread rubber has a thickness of 0.35 to 0.60 mm, especially 0.40 to 0.55 mm.

The thread rubber layer 2 preferably has a radial thickness of 3.5 to 8.0 mm, especially 5.0 to 6.5 mm. The center 1 and the thread rubber layer 2 form the wound core 3 which preferably has a weight of 35 to 38 grams, especially 36 to 37 grams.

The cover 4 enclosing the wound core 3 preferably has a radial thickness of 1.0 to 2.5 mm. A cover thicker than 2.5 mm would fail to provide a satisfactory initial velocity. A cover thinner than 1.0 mm would be less durable when the ball is topped. The cover preferably has a hardness of 70 to 93 on JIS C scale. Usually the cover is formed of synthetic resins such as ionomer resins and balata rubber alone or in admixture of two or more.

In this way, there is obtained a wound golf ball. At the same time when or after the wound core is enclosed with the cover, the cover is formed with dimples. The dimples may have any desired geometry distribution such as octahedral, eicosahedral and other polyhedral distribution, and any desired model such as square, hexagon and triangle models. Any conventional technique may be used for forming the cover around the wound core. For example, a cover is formed by placing the wound core in a mold and injection molding a cover-forming resin composition around the core. Alternatively, a pair of hemi-spherical half cups are preformed from a cover-forming resin composition, the wound core is enclosed with the pair of half cups, and thermo-compression molding is effected at about 110° to 160° C. for about 2 to 10 minutes.

The wound golf ball thus completed should have a diameter and weight complying with the Rules of Golf, namely a diameter of at least 42.67 mm and a weight of up to 45.92 grams. From the standpoints of hitting feel, restitution and durability, the ball preferably has such a hardness that its distortion under a load of 100 kg is 2.6 to 3.6 mm.

EXAMPLE

Examples of the present invention are given below by way of illustration and not by way of limitation.

Examples 1–6 & Comparative Examples 1–7

A liquid center was prepared. A pair of hemi-spherical half shells were prepared by blending components according to the rubber formulation shown in Table 1 and molding and vulcanizing it in a hemi-spherical mold. The liquid used was a blend of water with 7.2 grams of a paste having the formulation shown in Table 2. The half shells were joined together to form a rubber bag, which was filled with the liquid. The resulting liquid center had an outer diameter of 30 mm and a weight of 19.3 grams.

TABLE 1

| Center bag | Parts by weight |
|---|---|
| Formulation | |
| Natural rubber | 100 |
| Stearic acid | 1 |
| Zinc white | 40 |
| Vulcanization promoter/sulfur | 4 |
| Physical properties as vulcanized | |
| Hardness, JIS A scale | 52 |
| Specific gravity | 1.21 |
| Gage, mm | 2.3 |

TABLE 2

| Paste formulation | Parts by weight |
|---|---|
| Barium sulfate | 100 |
| Thickener (Na carboxymethyl cellulose) | 6 |
| Surfactant (dodecylbenzenesulfonic acid) | 4 |
| Water | 30 |

Next, thread rubber of the formulation shown in Table 3 having a width of 1.6 mm and a thickness of 0.45 mm was wound on the liquid center in three stages to form inner, intermediate and outer laminas by a conventional winding technique, obtaining a wound core. The inner, intermediate and outer laminas thus formed had the volume, diameter and elongation shown in Table 5. The elongation of each thread rubber lamina was measured as follows.

Elongation of thread rubber lamina

The rubber thread on the wound core was marked with gages A and A spaced 1 cm. The rubber thread was unwound from the wound core. The rubber thread in the unwound state was again marked with gages B and B spaced 1 cm. The rubber thread was stretched until the initial gages A and A were spaced 1 cm again. At this point, the distance C (cm) between the gages B and B was measured.

$$\text{Elongation}=(C-1)\times 100\%$$

A pair of half cups were prepared using balata rubber of the formulation shown in Table 4 as the cover-forming resin. The pair of half cups were mated around the wound core and joined thereto by a compression molding technique, obtaining a wound golf ball.

TABLE 3

| Thread rubber formulation | Parts by weight |
|---|---|
| Polyiosprene rubber | 70 |
| Natural rubber | 30 |
| Zinc white | 1.5 |
| Stearic acid | 1 |
| Vulcanization promoter/sulfur | 2.6 |

TABLE 4

| Cover Formulation | Parts by weight |
|---|---|
| Synthetic trans-polyisoprene rubber | 80 |
| High-impact styrene resin | 10 |
| Natural rubber | 10 |
| Zinc white | 10 |
| Titanium oxide | 10 |
| Stearic acid | 1 |
| Vulcanization promoter/sulfur | 1.5 |

The balls were examined for hardness, initial velocity and durability by the following tests. The results are shown in Table 5.

Ball hardness

Hardness is expressed by a distortion (mm) of a ball under a load of 100 kg.

Initial velocity

Using a swing robot, sample balls (n=12 for each Example) were hit by a driver at a head speed (HS) of 45 m/s to measure an initial velocity. An average of 12 balls is reported.

Durability

Using a swing robot, sample balls (n=20 for each Example) were hit at a head speed of 48 m/sec. against a target plate. Impact hitting was repeated 100 times to determine whether or not the balls were deformed. The number of intact balls is reported based on an index of 100 for Comparative Example 1.

Figure 3:
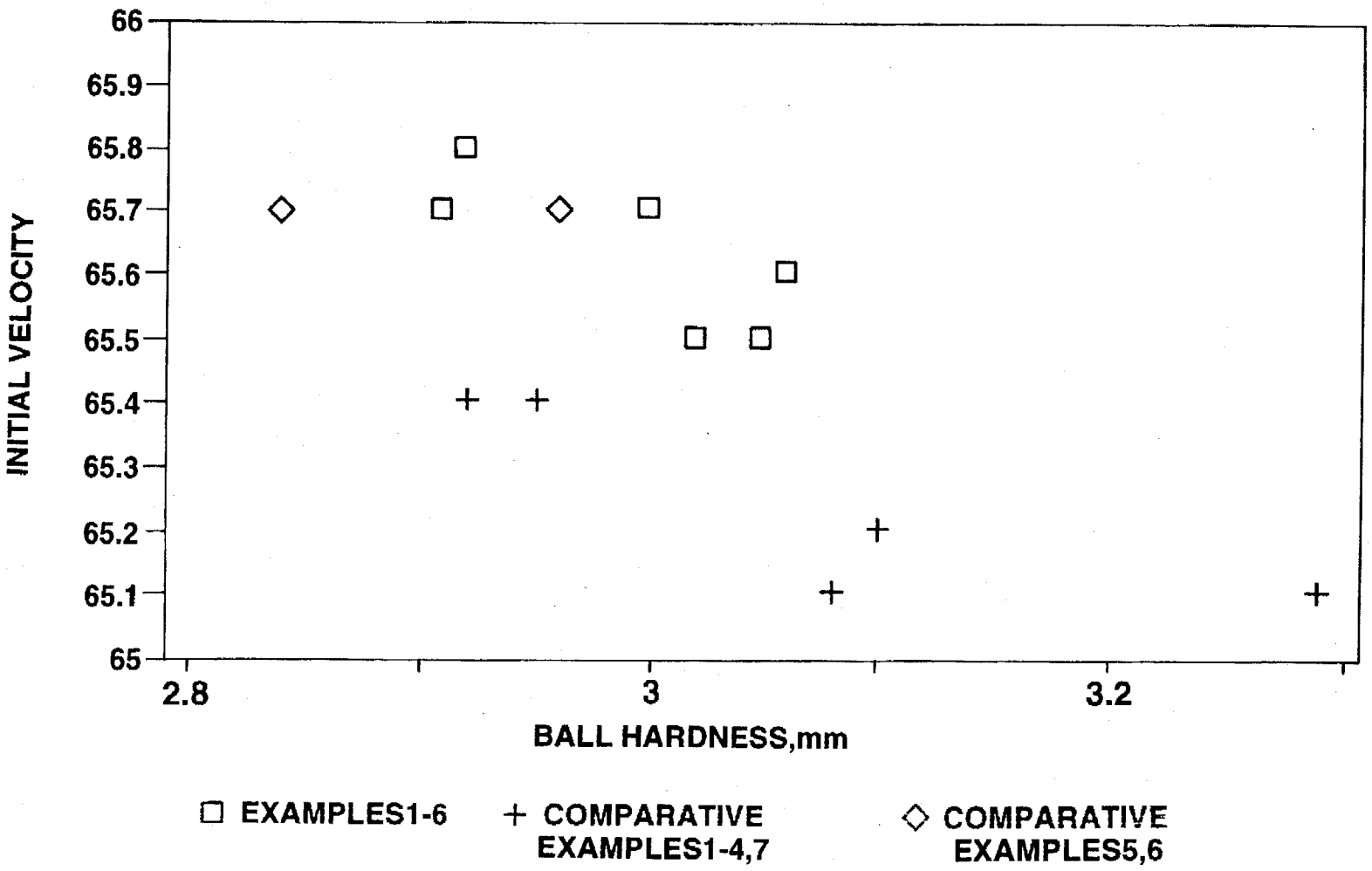
FIG. 3 is a diagram showing the initial velocity versus hardness of balls of Examples and Comparative Examples.

For the balls of Examples 1–6 and Comparative Examples 1–7, the initial velocity is plotted relative to the ball hardness (ball distortion) in the graph of FIG. 3.

TABLE 5

| | Example | | | | | | Comparative Example | | | | | | |
|---|---|---|---|---|---|---|---|---|---|---|---|---|---|
| | 1 | 2 | 3 | 4 | 5 | 6 | 1 | 2 | 3 | 4 | 5 | 6 | 7 |
| Thread rubber layer entire volume ($cm^3$) | 21.0 | 21.0 | 21.0 | 20.6 | 21.0 | 20.8 | 21.0 | 21.0 | 21.3 | 21.0 | 21.0 | 21.0 | 21.0 |
| Inner lamina | | | | | | | | | | | | | |
| Outer diameter (mm) | 31.8 | 32.2 | 33.1 | 34.0 | 34.0 | 34.0 | — | — | 35.6 | 34.0 | 31.2 | 35.5 | 35.6 |
| Volume ($cm^3$) | 2.7 | 3.3 | 4.9 | 6.4 | 6.4 | 6.4 | — | — | 9.5 | 6.4 | 1.8 | 9.3 | 9.3 |
| Volume share (%) | 13 | 16 | 23 | 31 | 31 | 31 | — | — | 45 | 30 | 8 | 44 | 44 |
| Elongation (%) | 850 | 850 | 850 | 880 | 860 | 860 | — | — | 860 | 860 | 850 | 920 | 860 |
| Intermediate lamina | | | | | | | | | | | | | |
| Outer diameter (mm) | 36.7 | 39.0 | 37.2 | 39.0 | 39.0 | 39.0 | — | — | 39.0 | 40.0 | 39.0 | — | — |
| Volume ($cm^3$) | 9.0 | 13.6 | 8.0 | 10.5 | 10.5 | 10.5 | — | — | 7.4 | 12.9 | 15.2 | — | — |
| Volume share (%) | 43 | 65 | 38 | 51 | 50 | 50 | — | — | 35 | 57 | 70 | — | — |
| Elongation (%) | 910 | 910 | 910 | 920 | 920 | 920 | — | — | 920 | 920 | 920 | — | — |
| Outer lamina | | | | | | | | | | | | | |
| Outer diameter (mm) | 40.7 | 40.6 | 40.6 | 40.5 | 40.6 | 40.6 | 40.6 | 40.6 | 40.74 | 40.6 | 40.6 | 40.6 | 40.6 |
| Volume ($cm^3$) | 9.3 | 4.1 | 8.2 | 3.7 | 4.0 | 3.9 | 21.0 | 21.0 | 4.35 | 1.5 | 6.4 | 11.7 | 11.7 |
| Volume share (%) | 44 | 19 | 39 | 18 | 19 | 19 | 100 | 100 | 20 | 7 | 30 | 56 | 56 |
| Elongation (%) | 850 | 860 | 870 | 840 | 840 | 860 | 900 | 870 | 810 | 830 | 830 | 860 | 920 |
| Ball | | | | | | | | | | | | | |
| Outer diameter (mm) | 42.68 | 42.68 | 42.68 | 42.67 | 42.67 | 42.68 | 42.68 | 42.68 | 42.67 | 42.68 | 42.67 | 42.68 | 42.68 |
| Weight (gram) | 45.2 | 45.1 | 45.2 | 45.1 | 45.2 | 45.2 | 45.2 | 45.1 | 45.2 | 45.2 | 45.2 | 45.1 | 45.2 |
| Hardness (mm) | 3.02 | 2.91 | 3.05 | 2.92 | 3.06 | 3.00 | 2.95 | 3.10 | 3.29 | 2.92 | 2.84 | 2.96 | 3.08 |
| Initial velocity (m/s) | 65.5 | 65.7 | 65.5 | 65.8 | 65.6 | 65.7 | 65.4 | 65.2 | 65.1 | 65.4 | 65.7 | 65.7 | 65.1 |
| Durability | 100 | 100 | 100 | 100 | 100 | 100 | 100 | 100 | 100 | 100 | 80 | 70 | 100 |

As is evident from Table 5, the wound golf balls of Examples 1 to 6 are improved in initial velocity and remain fully durable. The balls of Comparative Examples 1–4 and 7 are durable, but not improved in initial velocity. The balls of Comparative Examples 5 and 6 are improved in initial velocity, but less durable.

There has been described a thread wound golf ball which is increased in initial velocity and flying distance while remaining fully durable.

Although some preferred embodiments have been described, many modifications and variations may be made thereto in the light of the above teachings. It is therefore to be understood that within the scope of the appended claims, the invention may be practiced otherwise than as specifically described.

We claim:

1. A wound golf ball comprising;

a wound core having thread rubber wound on a center to form a thread rubber layer thereon and a cover around the wound core, said thread rubber layer consists essentially of three laminas, an inner lamina of lightly wound thread rubber, an intermediate lamina of tightly wound read rubber, and an outer lamina of lightly wound thread rubber, wherein said inner lamina, said intermediate lamina, and said outer lamina occupy 10 to 35%, 35 to 70%, and 15 to 45% by volume of the entire volume of the thread rubber layer, respectively, and said inner lamina and said outer lamina have an elongation which is at least 40% lower than the elongation of said intermediate lamina.

2. The wound golf ball of claim 1 wherein said center comprises a solid center.

3. The wound golf ball of claim 1 wherein said center is a liquid center.

4. The wound golf ball of claim 1 wherein said center has an outer diameter in the range of 26 to 32 mm and a weight in the range of 15 to 24 grams.

5. The wound golf ball of claim 1 wherein the elongation of said inner lamina is in the range of 50 to 80% lower than the elongation of said intermediate lamina.

6. The wound golf ball of claim 1 wherein the elongation of the outer lamina is in the range of 50 to 80% lower than the elongation of the intermediate lamina.

7. The wound golf ball of claim 1 wherein said thread rubber layer has a radial thickness in the range of 3.5 to 8.0 mm.

8. The wound golf ball of claim 1 wherein said thread rubber layer has a radial thickness in the range of 5.0 to 6.5 mm.

9. The wound golf ball of claim 1 wherein said center and said thread rubber layer have a combined weight in the range of 35 to 38 grams.

10. The wound golf ball of claim 1 wherein said cover has a radial thickness in the range of 1.0 to 2.5 mm.

11. The wound golf ball of claim 1 wherein said cover is formed of a material having a hardness in the range of 70 to 93 measured on JIS C.

12. The wound golf ball of claim 1 wherein said ball has a distortion under a load of 100 kg in the range of 2.6 to 3.6 mm.

13. The wound golf ball of claim 1 wherein said thread rubber has a thickness of 0.35 to 0.60 mm.

* * * * *